United States Patent [19]

Satomura et al.

[11] 4,181,328

[45] Jan. 1, 1980

[54] RECORDING ELEMENT

[75] Inventors: Masato Satomura; Masataka Kiritani, both of Fujinomiya; Taiichi Nishimura, Tokyo, all of Japan

[73] Assignee: Fuji Photo Film Co., Ltd., Minami-ashigara, Japan

[21] Appl. No.: 838,179

[22] Filed: Sep. 30, 1977

[30] Foreign Application Priority Data

Sep. 30, 1976 [JP] Japan ..... 51/117719

[51] Int. Cl.[2] ..... B41M 5/22; B41M 5/16

[52] U.S. Cl. ..... 282/27.5; 427/150; 427/151; 428/307; 428/914

[58] Field of Search ..... 282/27.5; 427/150, 151, 427/152; 428/307, 323, 411, 913, 914, 537; 106/21

[56] References Cited

U.S. PATENT DOCUMENTS

| | | | |
|---|---|---|---|
| 3,922,463 | 11/1975 | Masaoka et al. | 428/323 |
| 3,970,769 | 7/1976 | Kato et al. | 427/145 |
| 3,996,405 | 12/1976 | Porter | 428/307 |
| 4,041,193 | 8/1977 | Hayashi et al. | 427/151 |
| 4,070,508 | 1/1978 | Ishige et al. | 427/282 |

*Primary Examiner*—George F. Lesmes
*Assistant Examiner*—Bruce H. Hess
*Attorney, Agent, or Firm*—Sughrue, Rothwell, Mion, Zinn and Macpeak

[57] ABSTRACT

A recording element comprising a support and microcapsules provided thereon, which microcapsules contain a specific color-former and, as a solvent therefor, a triarylmethane type hydrocarbon compound.

10 Claims, No Drawings

RECORDING ELEMENT

BACKGROUND OF THE INVENTION

1. Field of the Invention

The present invention relates to a recording element and, more particularly, it is concerned with a recording element containing triarylmethane type hydrocarbon compounds as the solvent for a color former to be used.

2. Description of the Prior Art

Many investigations have been undertaken to develop recording systems wherein particular electron donating organic compounds possessing the capability of forming a color (hereinafter simply called a "color former") on reaction with an acidic electron accepting compound (hereinafter a "color developer") are employed, which include; for example, a pressure sensitive recording system, a heat sensitive recording system and so on.

Examples of these recording systems are disclosed in detail, for example, in U.S. Pat. Nos. 2,712,507; 2,730,456; 2,730,457; 3,418,250; 3,432,327; and so on.

These systems include a process using the combination of a sheet prepared by coating on a support a layer of microcapsules produced by microencapsulating oil droplets of a color former which is an almost colorless organic compound possessing an electron-donating capability (or a proton acceptability) and a color forming reactivity dissolved in an organic solvent such as alkyl naphthalenes, a so-called upper sheet, and a so-called lower sheet prepared by coating on the other sheet a color developer or optionally using a combination of an upper sheet, a middle sheet and a lower sheet, which middle sheet comprises a support which may be coated with a layer of microcapsules containing a color-former on one side thereof and with a color developer on the other side thereof, and applying a localized pressure to sheets superposed so that the microcapsule layer and the color developer layer are in contact with each other to result in a coloration in the areas to which the pressure has been applied, which is caused by a reaction occurring between the color-former arising upon rupture of the microcapsules present at the areas to which the pressure is applied and contact with the color developer; and another process comprising using a single sheet prepared by coating on one side of a support both a layer of the above-described microcapsules and a color developer and applying a localized pressure to result in a coloration automatically. In the latter case, one sheet alone is suitable as a recording paper and further, a superposition of a plurality of such single sheets enables copies to be made.

Specific examples of known solvents in which color formers employed for recording papers of the above-described kind can be dissolved include aromatic type oily liquids such as alkyl naphthalenes, alkylated diphenylalkanes, alkylated triphenyldimethanes, alkylated diphenyls and the like; ester type oily liquids; kerosene; chlorinated diphenyl; chlorinated paraffins; cotten seed oil; linseed oil; soybean oil and so on.

Suitable solvents for effective use in recording systems must have the following characteristics:

(1) Readily and easily dissolve the color formers to be used therein, (2) Contribute effectively to formation of a high density coloration, and (3) Low toxicity.

In addition, the following characteristics are required for commercial articles made therefrom:

(4) Low cost, and (5) An acceptable image density when written on with a ball point pen.

SUMMARY OF THE INVENTION

Therefore, an object of the present invention is to provide solvents which provide the above-described various characteristics.

The solvents which were discovered in the present invention can exhibit remarkable effects with respect to the above-described characteristics and particularly, (1), (5) and (6), compared with the conventional solvents.

The above-described object is attained by using, as the solvent for a color-forming agent, triarylmethane type compounds. In particular, the solvents of the present invention can exert remarkable effects upon the color-formers of the triarylmethane type leuco compounds.

Accordingly, this invention provides a recording element comprising a support having thereon a layer of microcapsules containing an electron donating organic color former compound and at least one triarylmethane hydrocarbon compound as a solvent for the color former compound.

DETAILED DESCRIPTION OF THE INVENTION

The triarylmethane type compounds which are employed in the present invention are represented by the following general formula (I):

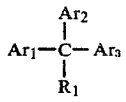

(I)

wherein $Ar_1$, $Ar_2$ and $Ar_3$, which may be the same or different, each represents an aryl group which may be substituted with substituents containing not more than 4 carbon atoms specific examples of which include alkoxy, allyl and alkyl (such as methyl, ethyl, propyl, butyl, isopropyl, isobutyl, sec-butyl, t-butyl etc.) groups) and more particularly, a methyl group; and $R_1$ represents a hydrogen atom or a substituent containing not more than 4 carbon atoms (specific examples of which include alkyl and haloalkyl groups) and preferably, a hydrogen atom or a methyl group.

Most preferred triarylmethane compounds represented by the general formula (I) above are those represented by the following general formula (II)

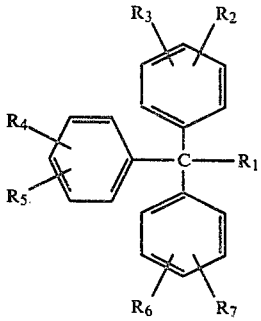

(II)

wherein $R_1$ is a hydrogen atom or a methyl group and $R_2$ to $R_7$ is a hydrogen atom or a methyl group and at least one of the benzene rings has two methyl groups.

The compounds represented by the above-described formula (I) are known compounds, and specific examples of these compounds include triphenylmethane, tolyldiphenylmethane, xylyldiphenylmethane, mesityldiphenylmethane, ditolylphenylmethane, xylyldiphenylmethane, dixylylphenylmethane, mesityltolylphenylmethane, cumenyldiphenylmethane and the like. The positions and the number of substituents replacing hydrogens present in the above-described compounds are not restricted to particular compounds, and they may be selected taking into account the cost, solubility of color formers therein and other characteristics which these substituents affect. Of these solvents, triarylmethane type compounds prepared using xylenes as one of the starting materials are preferred to other compounds because xylenes are easy to obtain.

In addition, although these compounds by themselves exist, in general, in a form of solids at an ordinary temperature (about 20°-30° C.), a combination of two or more and preferably, three or more of these compounds results in a marked decrease in the melting point to render the use of these compounds more advantageous. When these compounds are used as a combination thereof or in a combination with other solvents, suitable mixing ratios, of these compounds which can be used are found experimentally by examining whether the melting point of the resulting mixture is lower than about 30° C. and, more particularly, lower than 10° C., or not.

Moreover, these compounds may be used in combination with other known solvents, e.g., as described hereinbefore. In this case, a preferred amount of these compounds in the solvent contained in a microcapsule is at least more than about 10% by weight and more particularly, more than 50% by weight, of the total amount of solvent present.

Solvents which may be employed in combinations with the compounds of the present invention, include known solvents as described hereinbefore.

In this invention, the solvent for the color-former is restricted to those which possess a particular skeletal structure, and it should be noted that these compounds are not required to possess any special attributes, other than have the skeletal structure described above.

Known encapsulation techniques can be employed to encapsulate oil droplets of the color-former in the present invention. For example, a suitable technique is the coacervation process as disclosed in U.S. Pat. Nos. 2,800,457 and 2,800,458; another technique utilizes a interfacial polymerization process as disclosed in British Pat. No. 990,443 and U.S. Pat. No. 3,287,154; further techniques utilize a deposition of a polymer as disclosed in U.S. Pat. Nos. 3,418,250 and 3,660,304; still another technique utilizes a polymerization of reactants occurring in oil droplets as disclosed in U.S. Pat. Nos. 3,726,804 and 3,796,669; and so on. Of these techniques, techniques utilizing a deposition of a polymer and utilizing a polymerization of reactants occurring in oil droplets are particularly effective when applied to the encapsulation of the solvent of the present invention. In addition, the solvents of the present invention are capable of dissolving raw materials for formation of microcapsule walls to be used in an encapsulating process and therefore, they have another advantage that they can be very easily encapsulated. A suitable concentration of the color former in the solvent of this invention can range from about 1 to about 30% by weight, preferably 2 to 15% by weight, based on the total weight of the solvent.

Typical examples of organic color-formers, generally electron donating compounds, which can be employed in the present invention include triarylmethane type compounds, diphenylmethane type compounds, xanthene type compounds, thiazine type compounds, spiropyran type compounds and the like, e.g., as described in U.S. Pat. No. 3,970,769 and British Pat. No. 1,392,946.

Specific examples of these compounds are illustrated below. Specific examples of triarylmethane type color-formers include 3,3-bis(p-dimethylaminophenyl)-6-dimethylaminophthalide (Crystal Violet Lactone; hereinafter CVL), 3,3,-bis(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide and the like.

Specific examples of diphenylmethane type color-formers include 4,4'-bis-dimethylaminobenzhydrine benzyl ether, N-halophenyl leuco Auramine, N-2,4,5-trichlorophenyl leuco Auramine and the like.

Specific examples of xanthene type color-formers include Rhodamine-B-anilinolactam, Rhodamine-(p-nitroanilino)lactam, Rhodamine B(p-chloroanilino)lactam, 3-dimethylamino-6-methoxyfluoran, 3-diethylamino-7-methoxyfluoran, 3-diethylamino-7-chloro-6-methylfluoran, 3-diethylamino-7-(acetylmethylamino)fluoran, 3-diethylamino-7-(dibenzylamino)-fluoran, 3-diethylamino-7-(methylbenzylamino)fluoran, 3-diethylamino-7-(chloroethylmethylamino)fluoran, 3-diethylamino-7-(diethylamino)fluoran and the like.

Specific examples of color-formers of the thiazine type include benzoyl leuco methylene blue, p-nitrobenzyl leuco methylene blue and the like.

Specific examples of color-formers of the spiro type include 3-methyl-spiro-dinaphthopyran, 3-ethyl-spirodinaphthopyran, 3,3'-dichloro-spiro-dinaphthopyran, 3-methylnaphtho-(3-methoxy-benzo)-spiropyran, 3-propyl-spiro-di-benzodipyran and the like.

The combination of the color-former mixture comprising of at least one or more triarylmethane type leuco compounds (color former) with the triarylmethane type compounds with which may be employed as a solvent in the present invention, in particular, exhibits the most desirable effects, compared with other combinations. It is thought that this effect results from the similarity of the skeletal structure of the color-former to that of the solvent and thereby, high solubility of the color-former in solvent results.

When a pressure sensitive recording element is produced using a color former, a suitable coating amount is about 0.05 to about 3 g of the color former per $m^2$ of the support employed.

Examples of electron accepting solid acids which may be employed as a color developer include acid clay, active clay, attapulgite, bentonite, zeolite and other active clays; organic acid materials such as phenol resins; metal salts of aromatic carboxylic acids such as zinc salts of di-α-methylbenzyl salicylic acid; and so on.

A suitable amount of the color developer used when a recording element is produced ranges from about 0.1 to about 10 g of the color developer per $m^2$ of the support.

Various kinds of addenda such as binders, antioxidants, smudge-preventing agents and surface active agents, and coating methods therefore are well-known and described in U.S. Pat. Nos. 2,711,375 and 3,625,736; British Pat. No. 1,232,347; Japanese Patent Application (OPI) Nos. 44,012/75, 50,112/75, 127,718/75 and 30,615/75; U.S. Pat. Nos. 3,836,383 and 3,846,331; and so on.

Furthermore, the solvents of the present invention have the advantages that a small amount of the solvent of the present invention, as demonstrated in the Examples given hereinafter, is sufficient to dissolve the color-former to be used herein because of its high solubility and that, it can be handled with ease due to the excellent smoothness such exhibits when written on with a ball point pen, as described above.

The present invention will now be illustrated in greater detail by reference to the following examples. However, the invention is not intended to be construed as being limited to these examples. Unless otherwise indicated all parts, percents, ratios and the like are by weight. In the following examples, the preparation and the coating procedure of a solution of the color developing agent composed of acid clay were carried out as follows:

8 ml of a 20% by weight aqueous solution of sodium hydroxide was added as a dispersing agent to 300 g of water, to which 100 g of acid clay was added. The mixture was vigorously stirred in order to disperse the acid clay into the water. 40 g of a styrene-butadiene rubber latex (trade name: SBR latex No. 636, manufactured by Dow Chemical Corporation, Ltd.) was added as a binder to the resulting dispersion. Thus, the preparation of a color developer solution containing acid clay was completed. The thus obtained dispersion was coated on paper having a thickness of 50 g/$m^2$ at a coverage of 7 g/$m^2$ of solid components using an air-knife coating technique, and dried to obtain a lower sheet (hereinafter a color developer sheet).

EXAMPLE 1

8% by weight solutions of Crystal Violet Lactone were prepared by dissolving the prescribed amount of CVL into the solvent of the present invention (composed of 37% by weight of ditolylphenylmethane, 35% by weight of tolyldiphenylmethane, 16% by weight of triphenylmethane and 3% by weight of tritolylmethane), diisopropyl naphthalene (Reference Example 1) and 1-xylyl-1-phenylethane (Reference Example 2), respectively, and allowed to stand for 4 days at a temperature of 25° C. The color-former separated out in both the di-isopropyl naphthalene solution and the 1-xylyl-1-phenylethane solution after standing for 4 days. However, no precipitate of the color-former using the solvent of the present invention was observed in the solution of the present invention.

Therefore, the solvent of the present invention is preferred, compared with conventionally known solvents.

EXAMPLE 2

Microcapsules containing a color-former were prepared by the method disclosed in U.S. Pat. No. 2,800,457, as follows.

10 parts of acid-processed pig skin gelatin and 10 parts of gum arabic were dissolved in 400 parts of water at a temperature of 40° C., to which 0.2 part of Turkey red oil was added as an emulsifier. 40 parts of a color-former oil was added to the resulting emulsion and dispersed as an emulsion. Herein, each of the color-former oils was prepared by dissolving 2% by weight of Crystal Violet Lactone into Solvent A as described in Example 1, di-isopropyl naphthalene Solvent B and 1-xylyl-1-phenylethane Solvent C, respectively.

When the size of the droplets became 5 microns on the average, emulsification was discontinued, and then, water at 40° C. was added thereto to make the total weight 900 parts, and stirring was continued. A 10% by weight aqueous solution of acetic acid was added to adjust the pH to 4.0–4.2 with coacervation occurring.

After the stirring was further continued for 20 minutes, the resulting emulsion was cooled with ice water to gel the coacervate films deposited in the droplets.

7 parts of a 37% by weight aqueous solution of formaldehyde was added after the dispersion was cooled to 20° C. When the temperature of the dispersion was cooled to 10° C., a 15% by weight aqueous solution of sodium hydroxide was added to adjust the pH to 9. Then, the dispersion was heated to 50° C. with stirring for 20 minutes.

The thus-obtained microcapsule dispersion was cooled to 30° C. and, then, was coated on paper having a weight of 40 g/$m^2$ at a coverage of 6 g of solid contents per square meter, and dried.

Using the above-described procedures, a microcapsule sheet containing Crystal Violet Lactone as a color-former was obtained.

The thus obtained microcapsule sheet was written on using a ball point pen.

As a result, the handwritings became blurred on the capsule sheets prepared using Solvent B and Solvent C, respectively, for comparison. On the other hand, writing on the microcapsule sheet prepared using Solvent A was satisfactory to give beautiful handwritten images free from any blurring. These results demonstrate the solvent of the present invention to be excellent.

EXAMPLE 3

5 g of a polyvalent isocyanate adduct (an adduct of 3 mol of tolylene di-isocyanate and 1 mol of trimethylol propane) and 1 g of a polyol (ethylenediamine-propylene oxide adduct) were added as a wall film-forming material to an aromatic oily liquid prepared by dissolving 1.2 g of Crystal Violet Lactone into a mixed solvent of 15 g of tolyldiphenylmethane and 15 g of ditolylphenylmethane (melting point: below 10° C., boiling point: about 390° C.), and then the mixture was mixed thoroughly to obtain a first solution. Next, 3 g of polyvinyl alcohol and 1.5 g of the sodium salt of carboxy-methylcellulose were dissolved in 42 g of water at 20° C. Thereto, 0.1 g of Turkey red oil was additionally added as an emulsifier to obtain a second solution. The above-described first solution was poured into the second solution while the second solution was stirred vigorously to result in the formation of an oil-in-water type emulsion. When the size of the oil droplets become 6–10 microns, the speed of stirring was reduced. Then, 100 g of water at 20° C. was added to the resulting emulsion. After the conclusion of the water addition, the system was gradually heated to 75° C. and maintained at this temperature for 60 minutes.

To the thus obtained microcapsule solution 7.5 g of cellulose flock and 95 g of water were added to finish the preparation of the microcapsule solution.

The resulting microcapsule solution was coated on a paper having a weight of 50 g/m$^2$ using an air knife coating technique at a coverage of 5.0 g of solids content per square meter to obtain an upper sheet (hereinafter called a microcapsule sheet).

For the purpose of comparison, microcapsule sheets were prepared in the same manner as in Example 3 except that di-isopropyl naphthalene or 1-xylyl-1-phenylethane was employed as a solvent instead of the solvent of the present invention described above.

Each of the microcapsule sheets prepared as described above was superposed on the above-described color developer sheet, to which a pressure of 600 Kg/cm$^2$ was applied for coloration. The colored marks were allowed to stand for 3 days in the dark. Then, the density of each of the color marks was measured at a wavelength of 610 m$\mu$ using a Toshiba-Beckman DB type spectrophotometer. The coloration densities of these sheets were all about 1.04.

While the invention has been described in detail and with reference to specific embodiments thereof, it will be apparent to one skilled in the art that various changes and modifications can be made therein without departing from the spirit and scope thereof.

What is claimed is:

1. A recording element comprising a support having thereon a layer of microcapsules containing an electron donating organic color-former compound and at least one triarylmethane hydrocarbon compound as a solvent for the color former compound, wherein said triarylmethane hydrocarbon compound is represented by the general formula (I)

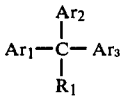

(I)

wherein $Ar_1$, $Ar_2$ and $Ar_3$, which may be the same or different, each represents an aryl group, which may be substituted with one or more substituents containing 4 carbon atoms or less; and $R_1$ represents a hydrogen atom or a substituent containing 4 carbon atoms or less.

2. The recording element of claim 1, wherein $Ar_1$, $Ar_2$ and $Ar_3$ each is a phenyl group or at least one of $Ar_1$, $Ar_2$ and $Ar_3$ is a phenyl group substituted with a methyl group and $R_1$ is a hydrogen atom or a methyl group.

3. The recording element of claim 1, wherein said triarylmethane hydrocarbon compound is triphenylmethane, tolyldiphenylmethane, xylyldiphenylmethane, mesityldiphenylmethane, ditolylphenylmethane, dixylylphenylmethane, mesityltolylphenylmethane or cumenyldiphenylmethane.

4. The recording element of claim 1, wherein said color former compound is a triarylmethane compound, a diphenylmethane compound, a xanthene compound, a thiazine compound or a spiropyran.

5. The recording element of claim 1, wherein said color former compound is a triarylmethane leuco compound.

6. The recording element of claim 1, additionally including on the support a layer of a solid acid as a color developer.

7. The recording element of claim 1, wherein said triarylmethane hydrocarbon compound is represented by the following general formula (II)

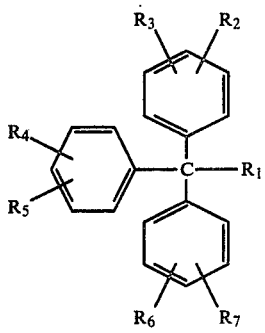

(II)

wherein $R_1$ is a hydrogen atom or a methyl group and $R_2$ to $R_7$ is a hydrogen atom or a methyl group and at least one of the benzene rings has two methyl groups.

8. The recording element of claim 1, wherein said triarylmethane compound is tolyldiphenylmethane.

9. The recording element of claim 1, wherein said triarylmethane compound is ditolylphenylmethane.

10. The recording element of claim 1, wherein said triarylmethane compound is a mixture of tolyldiphenylmethane and ditolylphenylmethane.

* * * * *